US010405595B1

(12) United States Patent
Kim

(10) Patent No.: US 10,405,595 B1
(45) Date of Patent: Sep. 10, 2019

(54) EYELASH APPLICATORS, MAGNETIC ARTIFICIAL EYELASHES, AND METHODS FOR USING THE SAME

(71) Applicant: KISS NAIL PRODUCTS, INC., Port Washington, NY (US)

(72) Inventor: Yeo Jin Kim, Port Washington, NY (US)

(73) Assignee: KISS NAIL PRODUCTS, INC., Port Washington, NY (US)

( * ) Notice: Subject to any disclaimer, the term of this patent is extended or adjusted under 35 U.S.C. 154(b) by 0 days.

(21) Appl. No.: 15/900,699

(22) Filed: Feb. 20, 2018

(51) Int. Cl.
*A41G 3/00* (2006.01)
*A45D 2/48* (2006.01)
*A41G 5/02* (2006.01)

(52) U.S. Cl.
CPC ..... *A41G 5/02* (2013.01)

(58) Field of Classification Search
CPC . A41G 5/02; A45D 2/48; A45D 26/00; A45D 26/0066; B25B 9/02; B25B 11/002
See application file for complete search history.

(56) References Cited

U.S. PATENT DOCUMENTS 1,960,687 A 5/1934 Wills
2,094,409 A 9/1937 Phillips, Sr.
5,307,826 A * 5/1994 Iosilevich ..... A45D 40/262 132/218
D395,733 S 6/1998 Ishida
6,230,715 B1 5/2001 Cho
D483,909 S 12/2003 Todeschini et al.
D492,066 S 6/2004 Cho
D495,834 S 9/2004 Todeschini et al.
D537,208 S 2/2007 Shaljian
(Continued)

FOREIGN PATENT DOCUMENTS

CN 202135850 U 2/2012
CN 106666901 A 5/2017
(Continued)

OTHER PUBLICATIONS (One Two Cosmetics A); Nov. 21, 2017, "One Two Cosmetics Full-Coverage Magnetic Eyelashes—How to apply with applicator tool" https://www.youtube.com/watch?v=SF_j84YMT_s accessed Apr. 2, 2019 [Cited in UK Combined Search and Examination Report in corresponding UK Application No. 1813262.1 dated Feb. 8, 2019].
(Continued)

*Primary Examiner* — Rachel R Steitz
(74) *Attorney, Agent, or Firm* — Venable LLP; Tamatane J. Aga; Kerri M. Patterson

(57) ABSTRACT

An exemplary artificial eyelash applicator arrangement can be provided, which can include, for example, a first handle portion can include (i) a first proximal portion and (ii) a first curved applicator portion configured to magnetically hold a top artificial eyelash(es) and connected to the first proximal portion, and a second handle portion coupled to the first handle side can include (i) a second proximal portion and (ii) a second curved applicator portion configured to magnetically hold a bottom artificial eyelash(es) and connected to the second proximal portion. The first handle portion or the second handle portion can include a hinge(s), and the first handle portion or the second handle portion can be configured to rotate about the hinge(s).

23 Claims, 7 Drawing Sheets

(56) References Cited

U.S. PATENT DOCUMENTS

| | | | | |
|---|---|---|---|---|
| D561,942 | S | 2/2008 | Khubani | |
| D569,041 | S | 5/2008 | Azoulay | |
| D706,978 | S | 6/2014 | Yu et al. | |
| D714,494 | S | 9/2014 | Vasquez et al. | |
| D810,534 | S | 2/2018 | Liu | |
| 2002/0094507 | A1 | 7/2002 | Feuer | |
| 2005/0166939 | A1 | 8/2005 | Stroud | |
| 2009/0217939 | A1* | 9/2009 | Rabe | A41G 5/02 132/218 |
| 2009/0223534 | A1 | 9/2009 | Green | |
| 2010/0096871 | A1* | 4/2010 | Ait-Mani | B25B 9/02 294/99.2 |
| 2010/0098591 | A1* | 4/2010 | Miyoshi | G01N 21/8483 422/82.09 |
| 2011/0278869 | A1 | 11/2011 | Lee et al. | |
| 2018/0235298 | A1 | 8/2018 | Zhao | |

FOREIGN PATENT DOCUMENTS

| | | | |
|---|---|---|---|
| GB | 1021063 | A | 2/1966 |
| GB | 1307107 | A | 2/1973 |
| JP | 2012-029809 | A | 2/2012 |

OTHER PUBLICATIONS (One Two Cosmetics B); Nov. 21, 2017, "One Two Cosmetics Magnetic half lash—How to apply with applicator tool", http://www.youtube.com/watch?v=HIXyBJnR4Cg accessed Apr. 2, 2019 [Cited in UK Combined Search and Examination Report in corresponding UK Application No. 1813262.1 dated Feb. 8, 2019].

* cited by examiner

EYELASH APPLICATORS, MAGNETIC ARTIFICIAL EYELASHES, AND METHODS FOR USING THE SAME

FIELD OF THE DISCLOSURE

The present disclosure relates generally to artificial eyelashes and applicators for applying such eyelashes, and more specifically, to exemplary embodiments of an exemplary magnetic eyelash applicators, magnetic artificial eyelashes, and methods for using the same.

BACKGROUND INFORMATION

Artificial eyelashes are used to enhance the length, curliness, fullness, and thickness of natural eyelashes. Artificial eyelashes can be made from several materials including mink, synthetic, or horse hair. Previous methods of applying artificial eyelashes use an adhesive glue to individually stick the artificial eyelashes to each natural/real eyelash one-by-one. This prevents the eyelashes from sticking together. However, such glue-based artificial eyelashes can be difficult to apply and remove, and over time, they can lose their ability to stick to real eyelashes.

In order to overcome some of the deficiencies in glue-based artificial eyelash, magnetic-based artificial eyelashes have been developed. Magnetic-based artificial eyelashes are typically applied to eyelashes using two opposing magnetic-based artificial eyelashes. Thus, glue is not necessary to connect and hold the artificial eyelashes. The magnetic-based artificial eyelashes are easy to use, waterproof, and reusable. However, certain prior magnetic-based artificial eyelashes have certain drawbacks, which can include being difficult to apply to the natural eyelashes, having inner and outer corners that can stick out from the edges of the eyelashes, etc. They can be expensive, and the magnetic-based artificial eyelashes may not fully adhere to the eyelash line. Many of these problems are due to the difficulty in applying such magnetic-based artificial eyelashes to natural eyelashes.

Thus, it may be beneficial to provide an exemplary magnetic eyelash applicator and method for using the same which can overcome at least some of the deficiencies described herein above.

SUMMARY OF EXEMPLARY EMBODIMENTS

An exemplary artificial eyelash applicator arrangement can be provided, which can include, for example, a first handle portion, which can include (i) a first proximal portion and (ii) a first curved applicator portion which can be configured to magnetically hold a top artificial eyelash(es), which can be connected to the first proximal portion, and a second handle portion coupled to the first handle side, which can include (i) a second proximal portion and (ii) a second curved applicator portion which can be configured to magnetically hold a bottom artificial eyelash(es) and can be connected to the second proximal portion. The first handle portion or the second handle portion can include a hinge(s), and the first handle portion or the second handle portion can be configured to rotate about the hinge(s).

In some exemplary embodiments of the present disclosure, the hinge(s) can include a first hinge and a second hinge, where the first handle portion can include the first hinge and the second handle portion can include the second hinge. The first handle portion and the second handle portion can include a first distal portion and a second distal portion, respectively, and the second handle portion can be coupled to the first handle portion by coupling the first and second distal portions to one another. The first proximal portion can be provided opposite to the second proximal portion. The hinge(s) can be connected to the first proximal portion or the second proximal portion. The first curved applicator portion can include a first metal structure disposed thereon, and the second curved applicator portion can include a second metal structure disposed thereon. The first metal structure can be curved to match the first curved applicator and the second metal structure can be curved to match the second curved applicator.

According to further exemplary embodiments of the present disclosure, the first curved applicator portion can include at least two first metal structures disposed thereon, and the second curved applicator portion can include at least two second metal structures disposed thereon. The at least two first metal structures can be curved to match the first curved applicator portion, and the at least two second metal structures can be curved to match the second curved applicator portion. A spring(s) can be included, which can be coupled to the first and second handle portions. The first proximal portion or the second proximal portion can be configured to rotate in a clockwise direction or counterclockwise direction. The first handle portion or the second handle portion can include a grip portion(s) disposed thereon.

A further exemplary embodiment of a magnetic eyelash applicator arrangement can be provided, which can include, for example, a first handle portion, which can include (i) a first proximal portion and (ii) a first curved applicator portion, which can be configured to magnetically hold a top artificial eyelash(es) and can be connected to the first proximal portion, where the first curved applicator portion can also include a first continuous strip of metal disposed thereon. A second handle side can be coupled to the first handle side and can include (i) a second proximal portion and (ii) a second curved applicator portion, which can be configured to magnetically hold a bottom artificial eyelash(es) and can be connected to the second proximal portion, where the second curved applicator portion can include a second continuous strip of metal disposed thereon.

In some exemplary embodiments of the present disclosure, the first handle portion or the second handle portion can include a hinge(s), where the first handle portion or the second handle portion can be configured to rotate about the hinge(s). The first handle portion or the second handle portion can be configured to rotate in a clockwise direction or counterclockwise direction. The first handle portion and the second handle portion can include a first distal portion and a second distal portion, respectively, where the second handle portion can be coupled to the first handle portion by coupling the first and second distal portions to one another. The first proximal portion can be provided opposite to the second proximal portion. The first continuous strip of metal can be curved to match a shape of the first curved applicator portion, and the second continuous strip of metal can be curved to match a shape of the second curved applicator portion. The first handle portion or the second handle portion can include a grip portion(s) disposed thereon.

A further exemplary embodiment of the present disclosure, which can include using the exemplary embodiments described above, can be a method of applying one or more sets of magnetic artificial eyelashes, which can include, for example, rotating a first handle portion of a magnetic eyelash applicator arrangement in a first direction, magnetically applying or coupling a top magnetic artificial eyelash(es) to the first handle portion or a second handle portion of the magnetic eyelash applicator arrangement, and magnetically applying or coupling a bottom magnetic artificial eyelash(es) to the first handle portion or the second handle portion of the magnetic eyelash applicator arrangement. The first handle portion can be rotated in a second direction, which can be a reverse direction of the first direction. The magnetic eyelash applicator arrangement can be placed over an eyelash of a person, and the top and bottom magnetic artificial eyelashes can be connected to the eyelash of the person.

These and other objects, features and advantages of the exemplary embodiments of the present disclosure will become apparent upon reading the following detailed description of the exemplary embodiments of the present disclosure, when taken in conjunction with the appended paragraphs.

BRIEF DESCRIPTION OF THE DRAWINGS

Further objects, features and advantages of the present disclosure will become apparent from the following detailed description taken in conjunction with the accompanying Figures showing illustrative embodiments of the present disclosure, in which.

Figure 1:
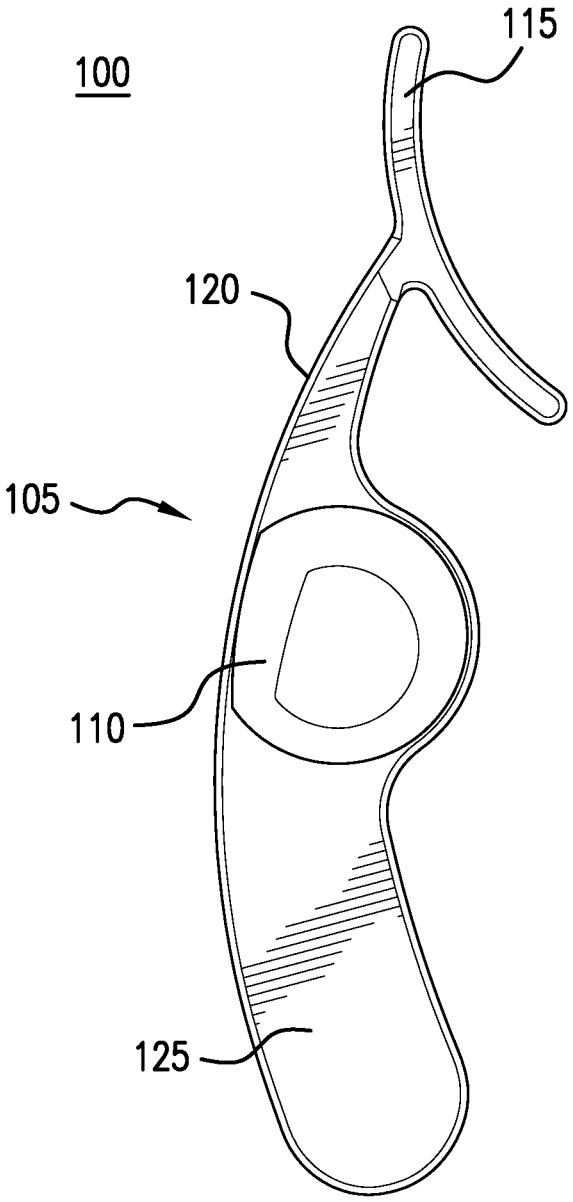
FIG. 1 is an exemplary diagram of a top-down view of an exemplary magnetic-based artificial eyelash applicator according to an exemplary embodiment of the present disclosure.

Throughout the drawings, the same reference numerals and characters, unless otherwise stated, are used to denote like features, elements, components, or portions of the illustrated embodiments. Moreover, while the present disclosure will now be described in detail with reference to the figures, it is done so in connection with the illustrative embodiments and is not limited by the particular embodiments illustrated in the figures and the appended paragraphs.

DETAILED DESCRIPTION OF EXEMPLARY EMBODIMENTS

Exemplary embodiments of the present disclosure may be further understood with reference to the following description and the related appended drawings. The exemplary embodiments of the present disclosure relate to a magnetic-based artificial eyelash applicator. For example, the magnetic-based artificial eyelash applicator can be used to apply a magnetic-based artificial eyelash to one or more eyebrows of a person. The exemplary embodiments are described with reference to an artificial eyelash, although those having ordinary skill in the art will understand that the exemplary embodiments of the present disclosure may be implemented in other applications where a magnetic-based hair extension is applied. It should be further understood that the term "artificial" with respect to the magnetic-based artificial eyelashes means that the lashes are not growing out of a person eyelids, although one or more portions of the magnetic-based artificial eyelash can be made of natural materials, including natural, hair, natural eyelashes, including but not limited to those of humans, animals, etc.

FIG. 1 shows an exemplary diagram of a top-down view of the exemplary magnetic-based artificial eyelash applicator 100 according to an exemplary embodiment of the present disclosure. For example, as shown in FIG. 1, magnetic-based artificial eyelash applicator 100 can include a handle portion or structure 105. Handle portion 105 can be connected to an applicator portion or structure 115. Applicator portion 115 can be used to hold or otherwise maintain one or more magnetic-based artificial eyelashes thereon in order to apply the magnetic-based artificial eyelashes to the eyelashes of a person. Handle portion 105 can include one or more grip portions or structures 110, which can facilitate superior holding of handle portion 105 by a person using magnetic-based artificial eyelash applicator 100. Grip portion 110 can be composed of the same material from handle portion 105, and can be indented from the surface of handle portion 105 (e.g., both handle portion 105 and grip portion 110 can be composed of plastic, rubber, or any other suitable material). Alternatively, grip portion 110 can be composed of a different material than handle portion (e.g., handle portion 105 can be composed of plastic and grip portion 110 can be composed of rubber, or vice versa). Additionally, grip portion 110 need not be indented from the surface of body portion 105.

As illustrated in FIG. 1, handle portion 110 can have a curved shape in a form of, e.g., partial circle, such that it bows out on one side with respect to an opposite side thereof. Handle portion 105 can also include a proximal portion 120 and a distal portion 125. Proximal portion 120 is provided between grip portion 110 and applicator portion 115. In particular, in the exemplary embodiment show in FIG. 1, proximal portion 120 has a wider width near grip portion 110, and a narrow width near applicator portion 115 such that proximal portion 120 tapers inward from grip portion 110 toward applicator portion 115. Distal portion 125 can have a general width that is greater than the widths of proximal portion 120 at or near grip portion 110 and at or near applicator portion 115. Further, distal portion 125 can include one or both of handles 205 and 210 (which are illustrated below in FIGS. 2 and 3).

Figure 2:
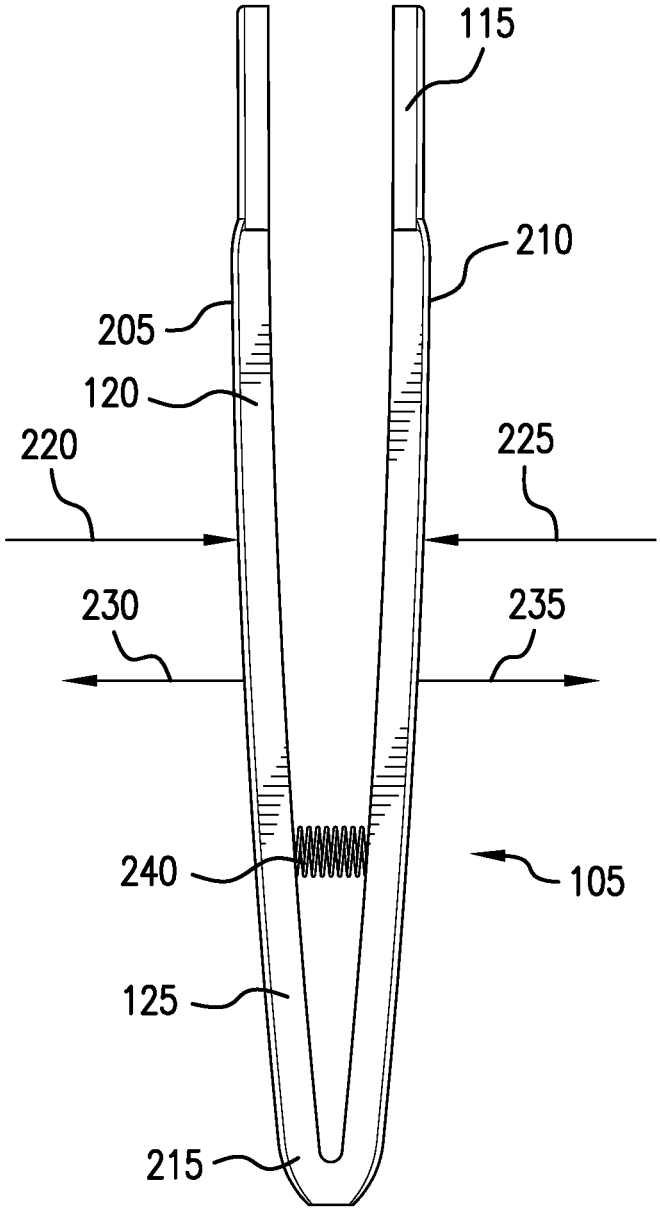
FIG. 2 is an exemplary diagram of a side view of the exemplary magnetic-based artificial eyelash applicator shown in FIG. 1 according to the exemplary embodiment of the present disclosure.
Figure 3:
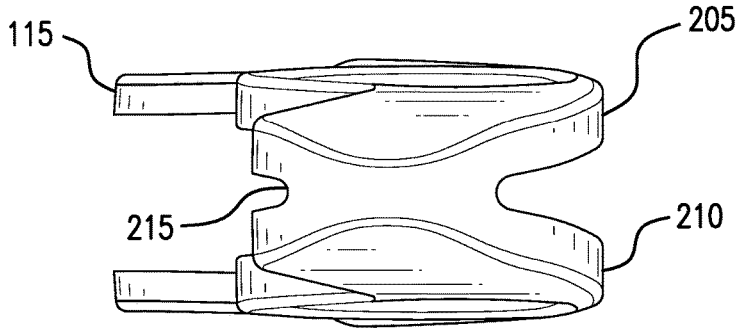
FIG. 3 is a further exemplary diagram of a bottom-top view of the exemplary magnetic-based artificial eyelash applicator shown in FIG. 1 according to the exemplary embodiment of the present disclosure.

FIGS. 2 and 3 show exemplary diagrams of differing views of the exemplary magnetic-based artificial eyelash applicator 100 shown in FIG. 1, according to the exemplary embodiment of the present disclosure. For example, as indicated above, exemplary proximal portion 125 can include two separate handles 205 and 210, which are connected by and extending from a connecting portion or structure 215. Connecting portion 215 can be used, e.g., with a spring 240, to provide a spring-like force on handles 205 and 210, thereby causing handles 205 and 210 to be separate from one another at one end, and also be pulled toward one another. During the use of magnetic-based artificial eyelash applicator 100, the user can press or force handles 205 and 210 together (e.g., using an inward force in the directions of arrows 220 and 225), opposing the force provided by spring 240. When the user ceases providing the inward pressure, connecting portion 215 forces handles 205 and 210 in an outward direction (e.g., the direction shown by arrows 230 and 235). Alternatively, or in addition, to the spring-like force applied by connecting portion 215, connecting portion 215—due to its configuration—can be used to resist any inward pressure in the direction of arrows 220 and 225.

Figure 4:
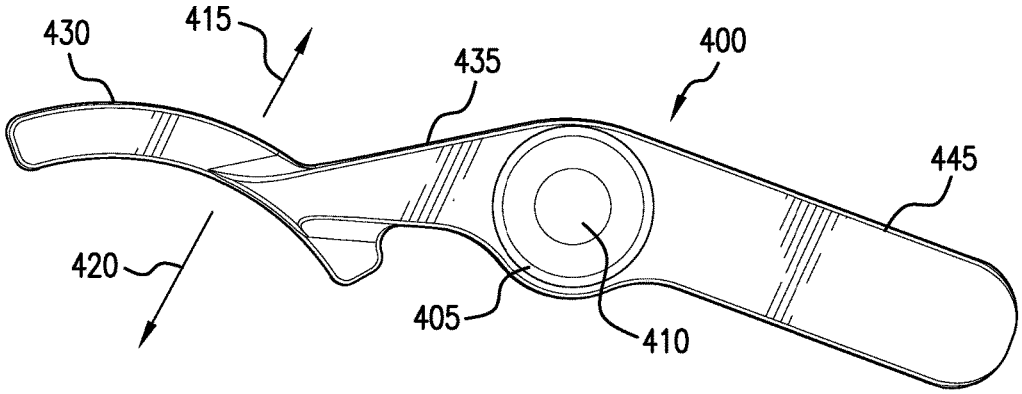
FIG. 4 is an exemplary diagram of a right side view of the exemplary magnetic-based artificial eyelash applicator according to another exemplary embodiment of the present disclosure.

FIG. 4 shows a further exemplary diagram of a top-down view of the exemplary magnetic-based artificial eyelash applicator 400 according to another exemplary embodiment of the present disclosure. For example, as shown in FIG. 4 and also in FIG. 5, which illustrates a perspective view of artificial eyelash applicator 400, applicator 400 can include a hinged portion or structure 405, a proximal portions 430, 435 to which respective applicator portions 430, 432 is attached, and distal portions 445, 450 which are connected to each other. Hinged portion 405 can include a pin 410, and can facilitate one or both of proximal portions 435 and 440 (shown in FIGS. 4 and 5) to be rotated to facilitate easy application of a magnetic-based artificial eyelash to magnetic-based artificial eyelash applicator 400 (e.g., as shown below). Hinged portion 405 can be connected to one or both of proximal portions 435, 440, and can be used to rotate or swing one or both of proximal portions 435, 440 in one or more directions (e.g., the directions of one or both of arrows 415 and 420). Hinge portion 405 can provide a certain resistance level such that one or both of proximal portions 435, 440 are not inadvertently rotated during the application of a magnetic-based artificial eyelash 400. For example, when a user rotates proximal portion 440, a certain amount of force may be needed to overcome the resistance provided by hinge portion 405 in order to rotate proximal portion 440.

Figure 5:
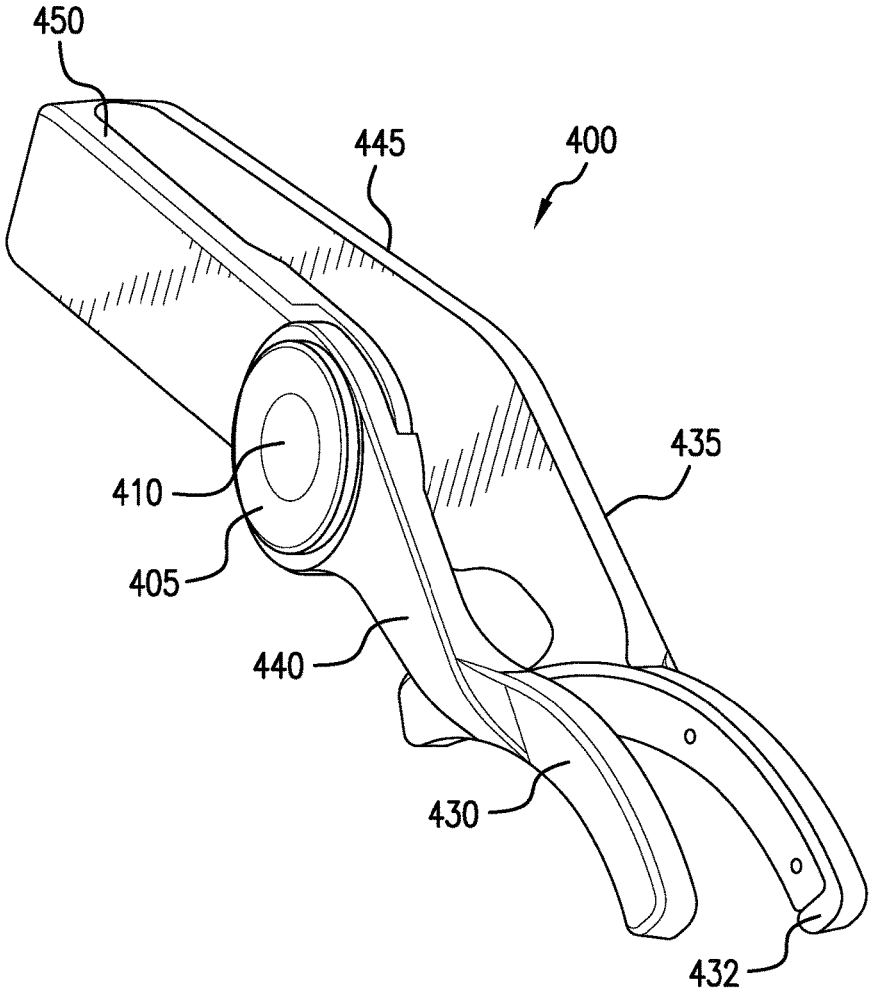
FIG. 5 is an exemplary diagram of a perspective view of the exemplary magnetic-based artificial eyelash applicator shown in FIG. 4 according to the exemplary embodiment of the present disclosure.

As shown in FIG. 5 hinge portion 405 can be located only in or connected to one of proximal portions 435, 440, (e.g., proximal portion 440), facilitating the rotation of proximal portion 440 with respect to handle 210.

Figure 6:
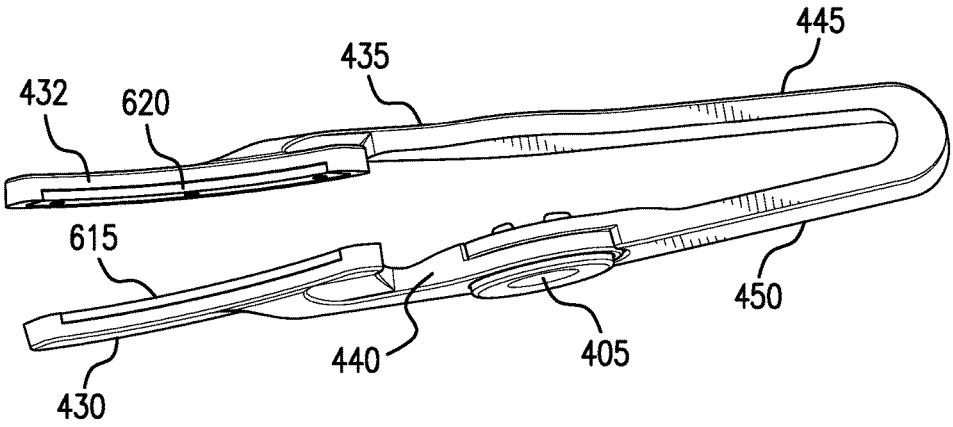
FIG. 6 is an exemplary diagram of a further side view of the exemplary magnetic-based artificial eyelash applicator shown in FIG. 4 according to the exemplary embodiment of the present disclosure.

FIG. 6 shows another side view of the exemplary magnetic-based artificial eyelash applicator illustrated in FIGS. 4 and 5, according to the exemplary embodiment of the present disclosure. For example, as shown in FIG. 6, proximal portions 435, 440 can each include or be connected to a respective applicator portion (e.g., applicator portions 432 and 430, respectively), which can be used to apply a magnetic-based artificial eyelash onto an eyelash of a person. Applicator portions 430, 432 can include metallic portions 615 and 620, respectively, which can be formed or at least partially composed from a metallic material that has magnetic qualities (e.g., it can be used to magnetically hold a magnetic-based artificial eyelash). Metallic portions 615 and 620 (each of which can be two or more metallic portions) can extend across most of the arc formed by each of applicator portions 432, 430, respectively (e.g., as shown in FIG. 6). Alternatively, one, two or more of each of metallic portions 615 and 620 can extend across the entire arc formed by each of applicator portions 432, 430, respectively.

Figure 7:
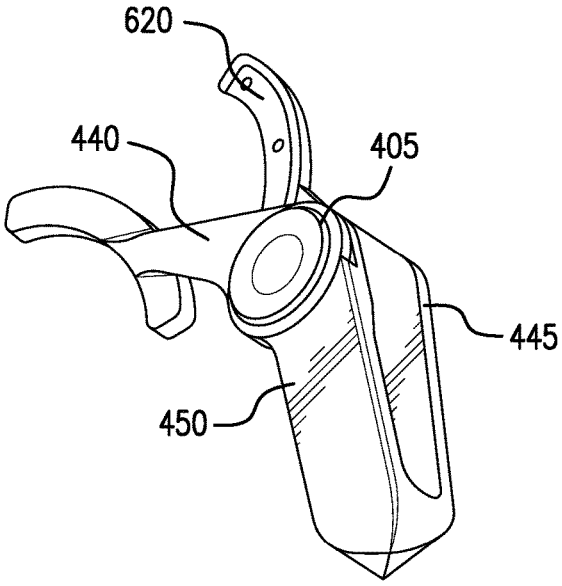
FIG. 7 is an exemplary diagram of a perspective view of the exemplary magnetic-based artificial eyelash applicator shown in FIG. 4 in an open position according to the exemplary embodiment of the present disclosure.

FIG. 7 shows an exemplary diagram of still another perspective view of the exemplary magnetic-based artificial eyelash applicator 400 illustrated in FIG. 4-6 in an open (e.g., rotated) position according to the exemplary embodiment of the present disclosure. For example, as shown in FIG. 7, proximal portion 440 can be rotated about hinge portion 405 such that proximal portion 440 and applicator portion 432 are rotated away with respect to distal portion 450, and avail access to proximal portion 435 and applicator portion 430. This can facilitate easy access to metallic portion 620 (or a plurality thereof) to apply a magnetic-based artificial eyelash to metallic portion 620.

Figure 8:
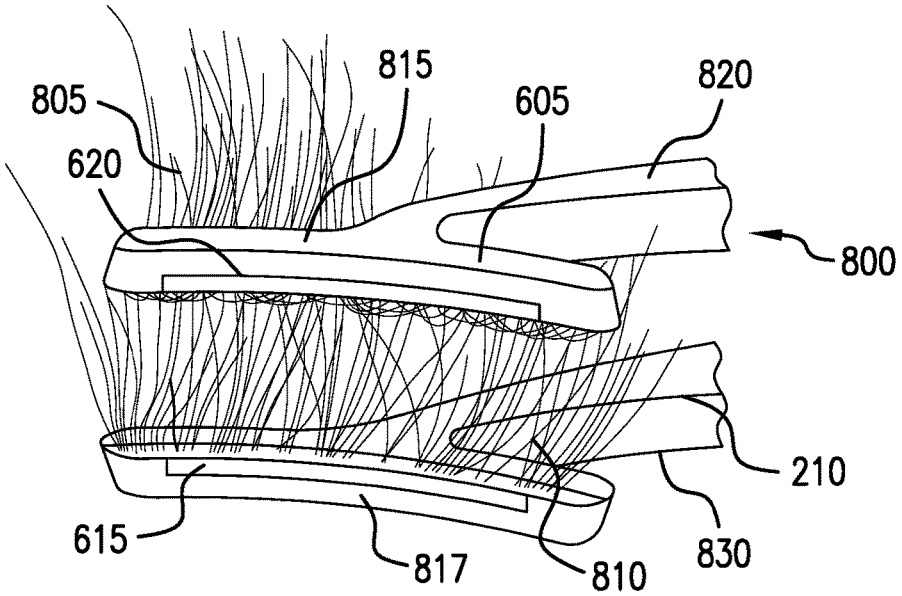
FIG. 8 is an exemplary image of a front portion of the exemplary magnetic-based artificial eyelash applicator having a magnetic-based artificial eyelash attached thereto according to an exemplary embodiment of the present disclosure.

FIG. 8 shows an exemplary image of a front portion of an exemplary magnetic-based artificial eyelash applicator 800 having a magnetic-based artificial eyelash attached thereto according to an exemplary embodiment of the present disclosure. It should be understood that exemplary magnetic-based artificial eyelash applicator 800 can be exemplary magnetic-based artificial eyelash applicator 100 of FIGS. 1-3 and/or exemplary magnetic-based artificial eyelash applicator 100 of FIGS. 4-7. For example, as shown in FIG. 8, applicator portions 815 and 817 of magnetic-based artificial eyelash applicator 800 (which can be applicator portion(s) 115 or applicator portion 430, 432) can include or have placed (or secured thereon, e.g., with adhesive or other attachment configuration) metallic portions 615 and 620, respectively. metallic portions 615 and 620 can be in a form of a strip extending along the length of the respective one of metallic portions 615 and 620, provided as two or more strips separated from one another, or other separate or connected segments (e.g., round, oval, etc.), Applicator portions 815 and 817 can each have magnetically attached thereto a magnetic-based artificial eyelash (e.g., magnetic-based artificial eyelashes 805 and 810) magnetically attached thereto. For example, metallic portion 615 can have magnetic-based artificial eyelash 805 attached thereto and metallic portion 620 can have magnetic-based artificial eyelash 810 attached thereto. In particular, magnetic-based artificial eyelashes 815 and 817 can include along a length thereof a magnetic part, e.g., a magnetic strip, two or more magnetic strips separated from one another, or other separate or connected magnetic segments (e.g., round, oval, etc.), When the magnetic-based artificial eyelash applicator 800 is squeezed together over an eyelash of a person, magnetic-based artificial eyelashes 805 and 810 are magnetically coupled together over the eyelash, and released from magnetic-based artificial eyelash applicator 800 by letting applicator 800 be released. Magnetic-based artificial eyelashes 805 and 810 can then sit over (e.g., by being magnetically attached to one another while having the real eyelash of the person provided there between) on the real eyelash of a person.

Figure 9:
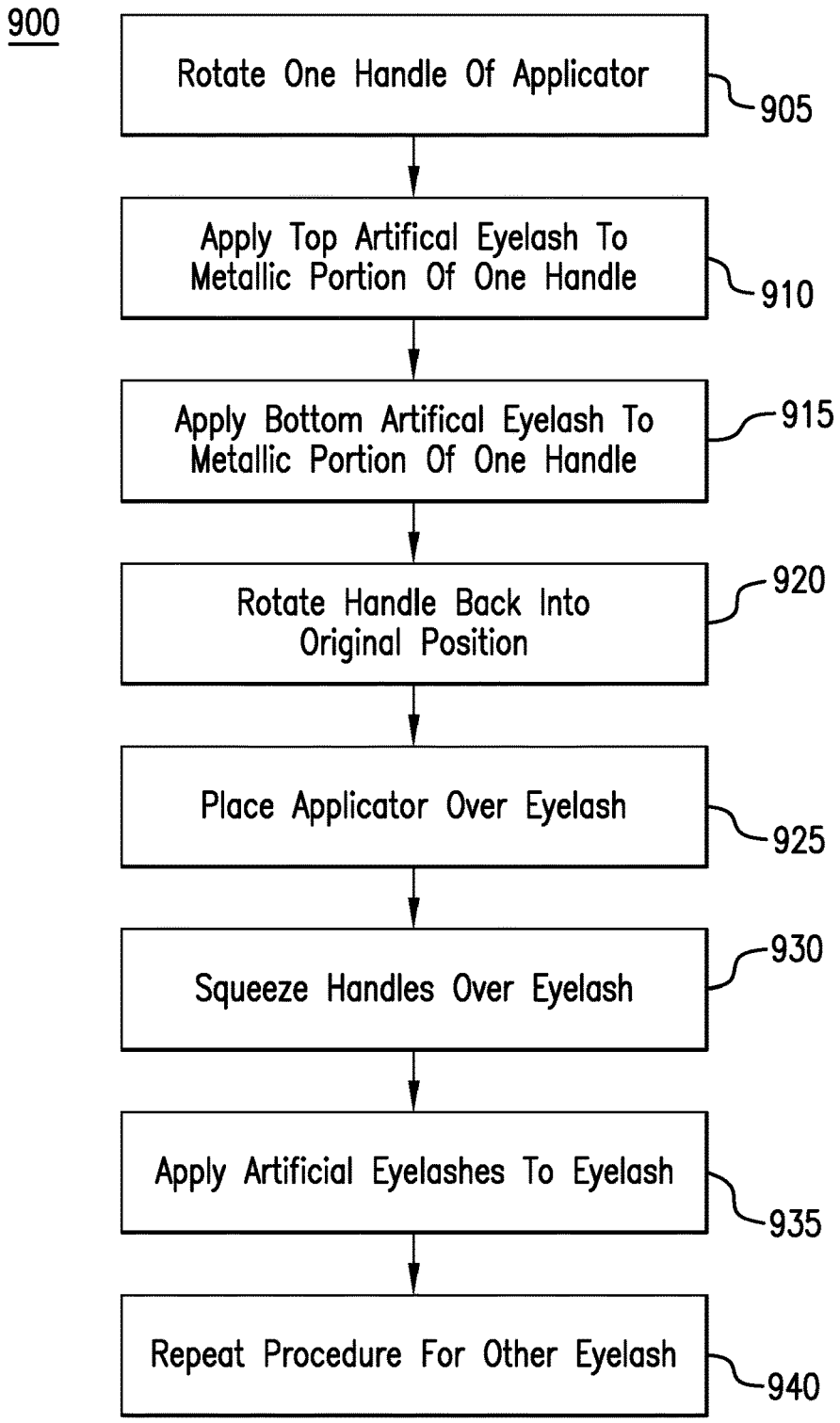
FIG. 9 is a flow diagram of an exemplary method of applying a magnetic-based artificial eyelash according to an exemplary embodiment of the present disclosure.

FIG. 9 shows a flow diagram of an exemplary method 900 of applying a magnetic-based artificial eyelash according to an exemplary embodiment of the present disclosure. For example, at procedure 905, one or more proximal portions (e.g., proximal portions 435, 440) of an applicator (e.g., magnetic-based artificial eyelash applicator 400) can be rotated to facilitate easier access to apply an artificial eyelash to the applicator. At procedure 910, an artificial top eyelash can be applied to a metallic portion (e.g., metallic portion 615) of one the proximal portions (e.g., proximal portion 435). At procedure 915, an artificial bottom eyelash can be applied to a metallic portion (e.g., metallic portion 620) of the other of the handles (e.g., handle 210). At procedure 920, the one or more rotated proximal portions can be rotated back into its/their original position. At procedure 925, the applicator (e.g., applicator portions 430, 432) can be placed over an eyelash of a person. At procedure 930, both handles (e.g., proximal portions 435, 440, hinged portion 405 and/or distal portions 445, 450 of applicator 400) can be squeezed over the eyelash of the person in order to apply the artificial eyelash at procedure 935. At procedure 940, procedures 905 through 935 can be repeated for the other eyebrow of the person.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, for example, data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

The invention claimed is:

1. An artificial eyelash applicator arrangement, comprising:

a first handle portion including (i) a first proximal portion and (ii) a first curved applicator portion configured to magnetically hold and maintain thereon at least one top artificial eyelash and connected to the first proximal portion; and a second handle portion coupled to the first handle portion and including (i) a second proximal portion and (ii) a second curved applicator portion configured to magnetically hold and maintain thereon at least one bottom artificial eyelash and connected to the second proximal portion, wherein at least one of the first handle portion or the second handle portion includes at least one hinge, wherein the at least one of the first handle portion or the second handle portion is configured to rotate about the at least one hinge, wherein the at least one hinge is configured to resist rotation of the first handle portion or the second handle portion, and wherein the first handle portion and the second handle portion include a first distal portion and a second distal portion, respectively, and wherein the second handle portion is coupled to the first handle portion by coupling the first and second distal portions to one another.

2. The artificial eyelash applicator arrangement of claim 1, wherein the at least one hinge includes a first hinge and a second hinge, and wherein the first handle portion includes the first hinge and the second handle portion includes the second hinge.

3. The artificial eyelash applicator arrangement of claim 1, wherein the first proximal portion is provided opposite to the second proximal portion.

4. The artificial eyelash applicator arrangement of claim 3, wherein the at least one hinge is connected to at least one of the first proximal portion or the second proximal portion.

5. The artificial eyelash applicator arrangement of claim 1, wherein the first curved applicator portion includes a first metal structure disposed thereon, and the second curved applicator portion includes a second metal structure disposed thereon.

6. The artificial eyelash applicator arrangement of claim 5, wherein the first metal structure is curved to match the first curved applicator portion and the second metal structure is curved to match the second curved applicator portion.

7. The artificial eyelash applicator arrangement of claim 1, wherein the first curved applicator portion includes at least two first metal structures disposed thereon, and the second curved applicator portion includes at least two second metal structures disposed thereon.

8. The artificial eyelash applicator arrangement of claim 7, wherein the at least two first metal structures are curved to match the first curved applicator portion, and the at least two second metal structures are curved to match the second curved applicator portion.

9. The artificial eyelash applicator arrangement of claim 1, further comprising at least one spring coupled to the first and second handle portions.

10. The artificial eyelash applicator arrangement of claim 1, wherein at least one of the first proximal portion or the second proximal portion is configured to rotate in at least one of a clockwise direction or counterclockwise direction.

11. The artificial eyelash applicator arrangement of claim 1, wherein at least one of the first handle portion or the second handle portion includes at least one grip portion disposed thereon.

12. The artificial eyelash applicator arrangement of claim 1, wherein the first proximal portion is configured to rotate in a first direction, and wherein the second proximal portion is configured to rotate in a second direction which is a reverse direction of the first direction.

13. The artificial eyelash application arrangement of claim 1, wherein the at least one hinge is configured to resist rotation of the first handle portion or the second handle portion by a predetermined level of resistance.

14. The artificial eyelash applicator arrangement of claim 13, wherein the at least one hinge is configured to allow rotation of the first handle portion or the second handle portion when a user applies a force to overcome the predetermined level of resistance.

15. A magnetic eyelash applicator arrangement, comprising:

a first handle portion including (i) a first proximal portion and (ii) a first curved applicator portion configured to magnetically hold and maintain thereon a first artificial eyelash and connected to the first proximal portion, wherein the first curved applicator portion includes a first continuous strip of metal disposed thereon; and a second handle portion coupled to the first handle portion and including (i) a second proximal portion and (ii) a second curved applicator portion configured to magnetically hold and maintain thereon a second artificial eyelash and connected to the second proximal portion, wherein the second curved applicator portion includes a second continuous strip of metal disposed thereon;

wherein the first handle portion includes a hinge, wherein the first handle portion is configured to rotate about the hinge to a first position for applying the first artificial eyelash to an eyelash of a user, and wherein the first handle portion and the second handle portion include a first distal portion and a second distal portion, respectively, and wherein the second handle portion is coupled to the first handle portion by coupling the first and second distal portions to one another.

16. The magnetic eyelash applicator arrangement of claim 15, wherein the first position of the first handle portion is opposite a position of the second handle portion for applying the first artificial eyelash and the second artificial eyelash to the eyelash of the user.

17. The magnetic eyelash applicator arrangement of claim 15, wherein the first handle portion is configured to rotate in at least one of a clockwise direction or counterclockwise direction.

18. The magnetic eyelash applicator arrangement of claim 15, wherein the first proximal portion is provided opposite to the second proximal portion.

19. The magnetic eyelash applicator arrangement of claim 15, wherein the first continuous strip of metal is curved to match a shape of the first curved applicator portion, and the second continuous strip of metal is curved to match a shape of the second curved applicator portion.

20. The magnetic eyelash applicator arrangement of claim 15, wherein at least one of the first handle portion or the second handle portion includes at least one grip portion disposed thereon.

21. The magnetic eyelash applicator arrangement of claim 15, wherein the first proximal portion is configured to rotate in a first direction, and wherein the second proximal portion is configured to rotate in a second direction which is a reverse direction of the first direction.

22. The artificial eyelash applicator arrangement of claim 1, wherein the second handle portion does not include a hinge.

23. A method of applying at least one set of magnetic artificial eyelashes, comprising:

rotating a first handle portion of a magnetic eyelash applicator arrangement in a first direction;

magnetically applying or coupling at least one top magnetic artificial eyelash to one of the first handle portion or a second handle portion of the magnetic eyelash applicator arrangement;

magnetically applying or coupling at least one bottom magnetic artificial eyelash to another one of the first handle portion or the second handle portion of the magnetic eyelash applicator arrangement;

rotating the first handle portion in a second direction, which is a reverse direction of the first direction;

placing the magnetic eyelash applicator arrangement over an eyelash of a person; and connecting the top and bottom magnetic artificial eyelashes to the eyelash of the person.

* * * * *